US006497551B1

(12) United States Patent
Hand et al.

(10) Patent No.: US 6,497,551 B1
(45) Date of Patent: Dec. 24, 2002

(54) TIP TREATMENT BARS IN A GAS TURBINE ENGINE

(75) Inventors: Derek G. Hand, Bristol (GB); Kevin J. Weaver, Clevedon (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 09/860,479

(22) Filed: May 21, 2001

(30) Foreign Application Priority Data

May 19, 2000 (GB) ..... 0012255

(51) Int. Cl.[7] ..... F01W 21/00
(52) U.S. Cl. ..... 415/9; 415/173.1
(58) Field of Search ..... 415/58.5, 58.7, 415/57.1, 57.3, 914, 173.1, 119, 9

(56) References Cited

U.S. PATENT DOCUMENTS 4,540,335 A 9/1985 Yamaguchi et al.
4,990,053 A * 2/1991 Rohne ..... 415/143
5,762,470 A * 6/1998 Gelmedov et al. ..... 415/119
6,164,911 A * 12/2000 LeBlanc et al. ..... 415/117

FOREIGN PATENT DOCUMENTS

WO WO 94/20759 9/1994

* cited by examiner

*Primary Examiner*—Edward K. Look
*Assistant Examiner*—Igor Kershteyn
(74) *Attorney, Agent, or Firm*—Oliff & Berridge, PLC

(57) ABSTRACT

A gas turbine engine casing includes a cavity 10 separated from the main flow 12 through the engine by an annular array of tip treatment bars 16. The tip treatment bars 16 are hollow which enables the bars to deform or break upon impact by a shed blade 4 or blade fragment. This allows the blade or blade fragment to pass through the tip treatment bars 16. Blade or blade fragments may then be contained within the cavity 10, or embedded in the casing 2, so preventing further damage to the engine. Entire blades, or large blade fragments, may be able to break through the tip treatment bars 16 and through the engine casing 2 so as to leave the engine entirely, causing the minimum of damage.

The interiors of the tip treatment bars may be filled with a damping material, to minimize high cycle fatigue failure.

14 Claims, 2 Drawing Sheets

TIP TREATMENT BARS IN A GAS TURBINE ENGINE

DESCRIPTION OF THE PRIOR ART

WO94/20759 discloses an anti-stall tip treatment means in a gas turbine engine, in which an annular cavity is provided adjacent the blade tips of a compressor rotor. The cavity communicates with the gas flow path through the compressor through a series of slots defined between solid tip treatment bars extending across the mouth of the cavity.

Such tip treatments are applicable to both fans and compressors of gas turbine engines, and their purpose is to improve the blade stall characteristics or surge characteristics of the compressor.

In a gas turbine engine, blades of a rotating stage may become damaged or become detached from the rotating hub on which they are mounted. Damage of this type may be caused, for example, by impact or foreign object damage such as a bird strike. The blade, or fragment of a blade, which is shed can cause catastrophic damage to other parts of the engine. The consequential effects of blade shedding can be. particularly serious it the blade in question is in the compressor stage of the engine, and particularly near the front of the compressor stage, since such blades are the largest and heaviest in the engine.

If an entire blade is shed, it is preferable in many cases for the blade to break through the engine. casing to exit the engine, rather than to remain within the engine where it may cause catastrophic failure. Blade fragments, however, are best contained within the engine, but prevented from reaching later compressor or turbine stages.

To minimise the consequential effects of the shedding or disintegration of a blade, it is desirable for the engine to include means for containing blade fragments while enabling whole blades (or very large blade fragments) to break through the engine casing with the minimum of disturbance to the operation of the engine. It is known to provide woven material around the exterior of the engine casing in order to prevent blades or blade fragments from penetrating through the engine casing. Such measures may therefore minimise damage to the engine casing by absorbing the detached blade or fragment, but they do not adequately prevent the travel of the detached blade or fragment through the remaining stages of the engine, Known tip treatment bars are solid and relatively robust and, in general, are as able as the adjacent parts of the casing to withstand impact from detached blades or blade fragments. They thus serve to keep detached blades and blade fragments within the engine, where they are liable to cause damage.

It is an object of the present invention to reduce the resistance of tip treatment bars to impact from detached blades or blade fragments.

It is a further object of the present invention to minimise the energy loss of a blade or blade fragment breaking through the.tip treatment bars.

It is a further object of the present invention to improve the damping characteristics of tip treatment bars.

BRIEF SUMMARY OF INVENTION

According to the present invention there is provided a gas turbine engine casing having hollow tip treatment bars.

By making the tip treatment bars hollow, their resistance to impact from detached blades or blade fragments may be reduced. Consequently, entire blades can break through the tip treatment bars and the engine casing to exit the engine. Blade fragments may also break through the tip treatment bars, but they will lose some of their kinetic energy as they do so, and may then be retained within the cavity, or embedded in the engine casing, outside the gas flow path through the engine. Thus they may be prevented from causing damage to other parts of the engine. Smaller blade fragments may become lodged between the tip treatment bars, again with the result that those fragments are prevented from damaging further parts of the engine.

The tip treatment bars may be mounted between end supports connected to, or forming part of, the casing of the engine. The tip treatment bars may be integral with the end supports.

In a preferred embodiment, the tip treatment bars are thin-walled components, so as to minimise the energy loss of a blade or blade fragment breaking through them.

Tip treatment bars are vulnerable to high cycle fatigue failure, as a result of engine-induced vibration in them. By making the tip treatment bars hollow, in accordance with the present invention, additional measures may be taken to damp such induced vibrations, and so inhibit the initiation and propagation of fatigue cracking. For example, the hollow tip treatment bars may be filled, wholly or partially, with a damping material, Viscoelastic materials are suitable for this purpose and elastomers, such as silicone elastomers may be used.

DETAILED DESCRIPTION

Figure 1:
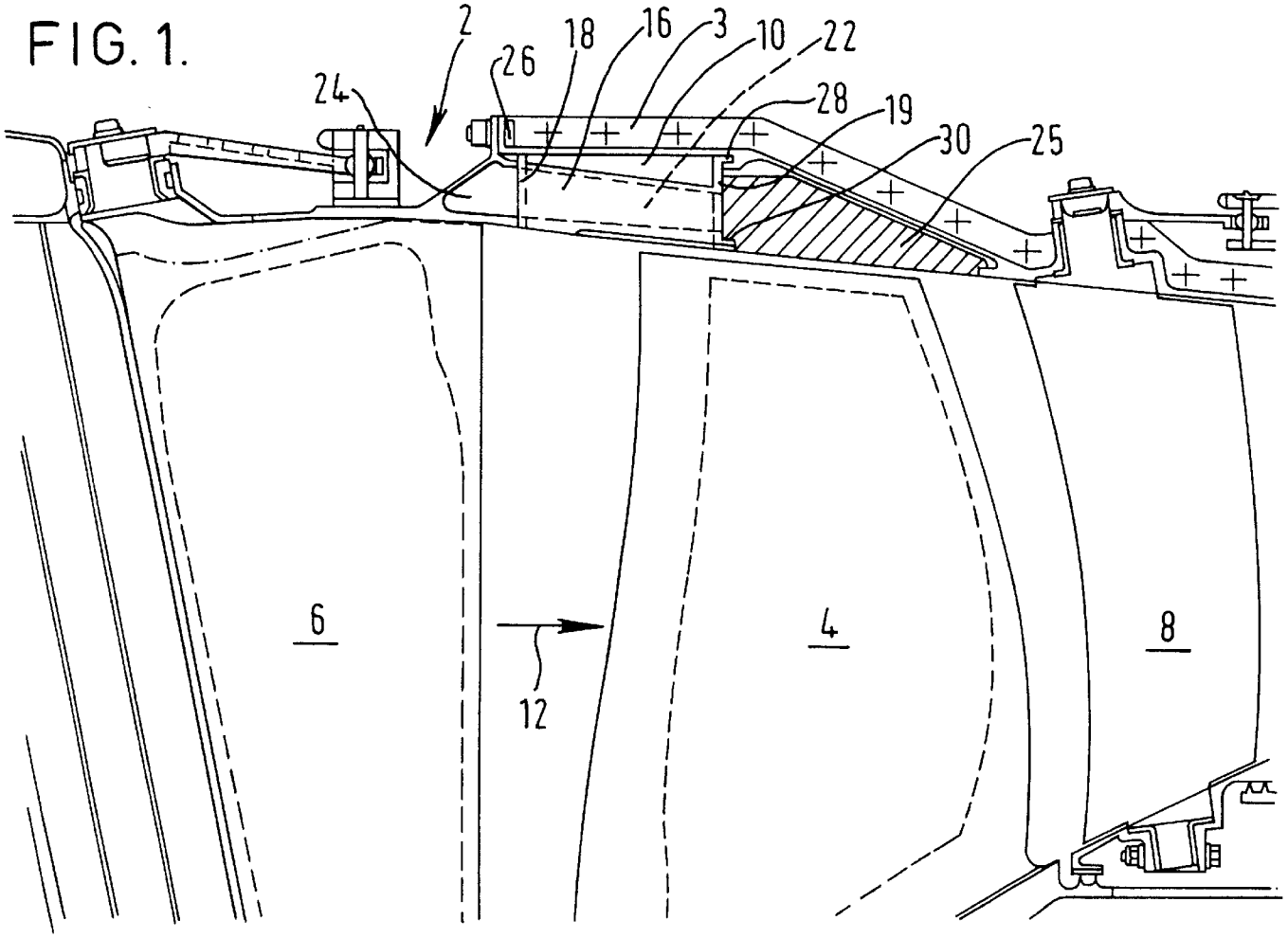
FIG. 1 is a partial axial sectional view of a fan stage in a gas turbine engine.

FIG. 1 represents a fan casing 2 of a gas turbine engine. A layer 3 of woven material, such as KEVLAR, may be provided around the outside of the casing 2. A fan 4, represented by a single blade, is mounted for rotation in the casing 2. Guide vanes 6 and 8 are provided upstream and downstream, respectively, of the fan 4. The casing 2 includes a circumferentially extending chamber 10, which communicates with the main gas flow through the fan (represented by an arrow 12) through an array of slots 14 defined between tip treatment bars 16 disposed around the casing. The function of the chamber 10 in delaying the onset of stalling of the blades 4 is disclosed in International Patent Publication WO94/20759.

The tip treatment bars 16 are supported by annular front and rear end supports 18, 19 to provide a tip treatment ring 20 which is fitted within the casing 2 and extends around the fan 4. The end supports 18, 19 and the bars 16 are formed or fabricated so as to be integral with each other. As an alternative, the end supports 18, 19 may be made separately. The bars 16 and the end supports 18, 19 may be made from any suitable metallic or composite material.

Figure 2:
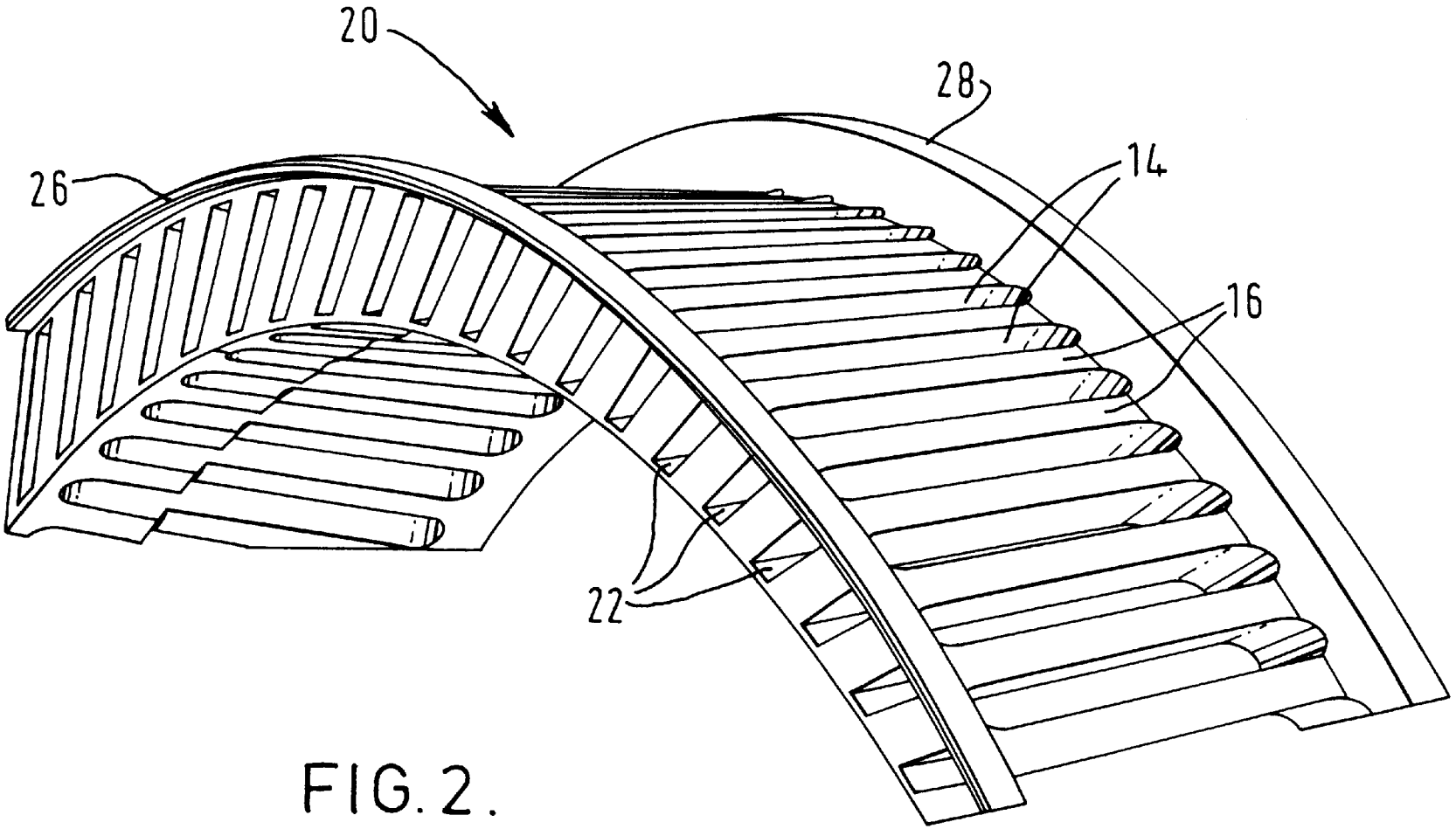
FIG. 2 is a partial view of a tip treatment ring suitable for use in the engine of FIG. 1.

As can be appreciated trout FIG. 2, the tip treatment bars 16 are hollow, defining an internal passage 22. These passages open at the front end and rear end supports 18 and 19. At the front, they open into a common annular chamber 24 formed in the casing 2. The passages 22 open at the rear end support 19 into a common chamber 25, which way accommodate a filling material, for example of honeycomb structure.

The end support 18 has a forwardly facing flange 26 at its radially outer edge, and the rear end support 19 has rearwardly directed flanges 28, 30 at its radially outer and inner edges, respectively. These flanges 26, 28, 30 serve to locate the tip treatment ring 20 within the overall structure of the casing 2.

Each tip treatment bar 16 has a relatively thin wall thickness in relation to its radial height. This thickness may, for example, be in the range 0.5 mm to 1.5 mm and is preferably approximately 1 mm. The effect of this reduced wall thickness is that, although the tip treatment bars 16 are able to withstand the forces applied to them in normal operation of the engine, they can deform or break relatively easily if struck by a blade or a blade fragment.

Thus, if, for example, a blade of fan 4 disintegrates, blade fragments, and possibly the entire blade, will be thrown radially outwardly. Some of these fragments will travel forwards, under the loads imposed on them in operation, and will impinge upon the tip treatment ring 20. Because of their hollow, thin-walled structure, the tip treatment bars 16 will easily fracture and deform and the blade fragments will either be trapped between them, or pass through into the cavity 10, where they will be retained out of the normal airflow 12 through the engine, perhaps by becoming embedded in the engine casing 2. If the engine blade becomes detached from the fan 4, its kinetic energy may be sufficiently great to break through not only the tip treatment bars 16 but also the engine casing, which is regarded as a desirable outcome in such circumstances. Consequently, damage to the remaining blades of the fan 4 shown in FIG. 1, to the immediately downstream guide vane 8, and subsequent parts of the engine can be avoided or minimised.

The hollow nature of the tip treatment bars 16, particularly if the bars are wholly or partially filled with a viscoelastic damping material, may serve to reduce the amplitude of induced vibrations in the tip treatment bars 16. This measure, therefore, can reduce the incidence of high cycle fatigue failure in the tip treatment bars 16. In addition, the use of the hollow tip treatment bars 16 may provide weight-saving advantages.

What is claimed is:

1. A gas turbine engine casing having hollow tip treatment bars.

2. A gas turbine engine casing as claimed in claim 1, in which the tip treatment bars are disposed in a circumferential array around the casing.

3. A gas turbine engine casing as claimed in claim 1, further comprising oppositely disposed annular end supports, between which the tip treatment bars are supported.

4. A gas turbine engine casing as claimed in claim 3, in which the tip treatment bars are integral with the end supports.

5. A gas turbine engine casing as claimed in claim 1, in which the tip treatment bars have a relatively thin wall section.

6. A gas turbine engine casing as claimed in claim 5 in which at least a portion of the thin wall section of each tip treatment bar has a thickness lying in the range 0.5 mm to 1.5 mm.

7. A gas turbine engine casing as claimed in claim 1, in which an interior of each tip treatment bar is at least partially filled with a damping material.

8. A gas turbine engine casing as claimed in claim 7, in which the damping material is a viscoelastic material.

9. A gas turbine engine casing comprising:

oppositely disposed annular end supports;

a plurality of tip treatment bars disposed in a circumferential array and supported between the annular end supports, the tip treatment bars being hollow; and damping material provided within an interior of each tip treatment bar.

10. A gas turbine engine as claimed in claim 9, in which the tip treatment bars are integral with the end supports.

11. A gas turbine as claimed in claim 9, in which the tip treatment bars have a relatively thin wall section.

12. A gas turbine engine section as claimed in claim 11 in which the wall thickness of at least a portion of each tip treatment bar lies in the range 0.5 mm to 1.5 mm.

13. A gas turbine engine casing as claimed in claim 9, in which the damping material is a visco elastic material.

14. A gas turbine engine comprising:

a casing;

a rotor which is rotatable within the casing, the rotor being provided with a plurality of blades;

the casing comprising:

oppositely disposed annular end supports;

a plurality of tip treatment bars supported between the annular end supports, the tip treatment bars being hollow; and damping material provided within an interior of each tip treatment bar, the tip treatment bars disposed in a circumferential array surrounding the blades of the rotor.

* * * * *